US006178771B1

(12) United States Patent
Yun

(10) Patent No.: US 6,178,771 B1
(45) Date of Patent: Jan. 30, 2001

(54) SUCTION ACCUMULATOR

(75) Inventor: Kyung Woo Yun, Kwangju (KR)

(73) Assignee: Carrier Corporation, Syracuse, NY (US)

( * ) Notice: Under 35 U.S.C. 154(b), the term of this patent shall be extended for 0 days.

(21) Appl. No.: 09/280,743

(22) Filed: Mar. 29, 1999

(51) Int. Cl.[7] ..... F25B 43/00; F25B 43/02
(52) U.S. Cl. ..... 62/503; 62/471
(58) Field of Search ..... 62/503, 470, 471, 62/475, 468, 84

(56) References Cited

U.S. PATENT DOCUMENTS 4,111,005 * 9/1978 Livesay ..... 62/503
4,194,371 * 3/1980 Morse ..... 62/503
5,347,829 * 9/1994 Newman ..... 62/503 X
5,377,501 * 1/1995 Muston ..... 62/475 X
5,507,159 * 4/1996 Cooksey ..... 62/503
5,660,058 * 8/1997 Harris et al. ..... 62/471
5,868,001 * 2/1999 Shoulders ..... 62/503

* cited by examiner

*Primary Examiner*—William Doerrler
*Assistant Examiner*—Chen-Wen Jiang

(57) ABSTRACT

The suction feed pipe of an accumulator extends above the flow path through a baffle dividing the accumulator thereby permitting the storage of a larger amount of liquid in the accumulator. Where the accumulator has a portion located below the fluid connection going into the compressor, this portion can be used to store a charge of make-up oil to replace the oil distributed in the system during operation without initially overcharging the compressor or of compromising the compressor oil charge.

12 Claims, 4 Drawing Sheets

SUCTION ACCUMULATOR

BACKGROUND OF THE INVENTION

In an inactive air conditioning or refrigeration system, refrigerant tends to condense and collect at low and/or cool locations in the system. Because of the affinity between refrigerants and the lubricants used therewith, oil is normally present in the refrigerant. If liquid refrigerant and/or oil is drawn into the compressor, a condition known as slugging occurs. Because liquids are essentially incompressible, the increased volume required to be discharged due to the incompressibility can cause damage to the compressor. This damage is due to the pressure build up caused by the higher than design volumetric flow due to the incompressibility of the liquid refrigerant and/or oil.

To avoid liquid slugging, a suction accumulator is commonly located immediately upstream of the suction of the compressor of an air conditioning or refrigeration system. An accumulator serves two major purposes in that it acts as a sump for storing liquid refrigerant and any associated oil as well as serving to meter the feeding of the liquid refrigerant/oil back to the compressor. The suction feed pipe extends into the accumulator to a height above the design level of liquid refrigerant/oil and has a metered opening in fluid communication with the interior of the accumulator in a lower portion of the accumulator corresponding to a minimum residual liquid refrigerant/oil level.

When the compressor is started after a sufficient time for liquid refrigerant and associated oil to collect in the accumulator, the liquid which has entered and collected in the suction feed pipe will tend to be drawn into the compressor with the liquid refrigerant tending to evaporate due to the reduced pressure associated with the suction stroke of the compressor. Other than the initial liquid in the suction feed pipe, gaseous refrigerant will be drawn from the evaporator into the accumulator and via the suction feed pipe into the compressor with the flow entering the suction feed pipe at a location in the upper portion of the accumulator. Additionally, any liquid in the accumulator at a level such as to be in fluid communication with the metered opening will be drawn into the suction flow on a metered basis with the liquid refrigerant tending to be evaporated in being aspirated into the suction flow. The metered flow into the suction feed pipe will continue until the liquid level is brought down to the level of the metered opening.

SUMMARY OF THE INVENTION

The present invention locates the inlet to the suction feed pipe at a higher location in the accumulator thereby permitting the storage of a larger volume of liquid in the accumulator without changing the dimensions of the accumulator. Specifically, for a given size/height of an accumulator, the factors limiting the storage volume are the location of the baffle and standpipe tip or inlet. Conventionally, the baffle is located where the straight body portion of the accumulator casing ends and the tip of the standpipe is located at a lower point than the baffle. The relocation of the inlet to the suction feed pipe to a point above the baffle screen/ports in the baffle is achieved through the use of a baffle which accommodates the increased height of the suction feed pipe and which coacts therewith to require two 180° turns in the flow entering the accumulator before it reaches the inlet of the suction feed pipe thereby tending to separate out any entrained liquid due to centrifugal action. As a result of the use of the present invention, more liquid can be stored for a given size of accumulator body as compared to a conventional accumulator which can only use 40–60% of its volume for liquid storage. Alternatively, a smaller accumulator can be used to store the same amount of liquid as compared to a conventional accumulator. Additionally, the more circuitous flow path has the unexpected benefit of quieter operation.

As noted, the present invention permits a greater liquid volume storage but, if desired, the original storage capacity can be maintained while reducing the size of the accumulator. Because the accumulator can be directly connected to and supported by the compressor, the full height of the compressor may be available for the accumulator. This extra height provides a unique opportunity in that it permits extending the accumulator to a lower level which is beneath the suction inlet of the compressor. Because the accumulator is located below the suction inlet, this lower portion may be initially charged with oil to avoid the alternative of providing excess oil within the compressor. Since oil is carried through the refrigeration system with the refrigerant, a portion of the oil disappears with respect to the compressor due to its coating and collecting in various parts of the system. Accordingly, this design permits providing the required excess oil without interfering with compressor operation since the excess oil is metered from the accumulator into the circulating refrigerant when the system is initially run.

It is an object of this invention to increase the liquid refrigerant storage capacity of an accumulator.

It is another object of this invention to provide a quieter accumulator.

It is a further object of this invention to provide a circuitous gas flow path in an accumulator. These objects, and others as will become apparent hereinafter, are accomplished by the present invention.

Basically, the suction feed pipe of an accumulator extends above the flow path through a baffle dividing the accumulator thereby permitting the storage of a larger amount of liquid in the accumulator. Where the accumulator has a portion located below the fluid connection going into the compressor, this portion can be used to store a charge of make-up oil to replace the oil distributed in the system during operation without initially overcharging the compressor or compromising the compressor oil charge.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
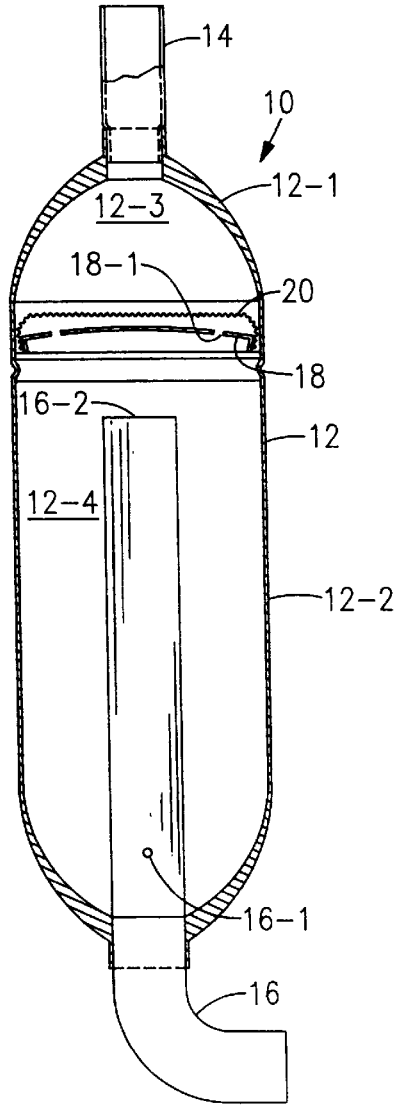
FIG.1 Prior Art
FIG. 1 is a partially sectioned view of a PRIOR ART accumulator.
Figure 3:
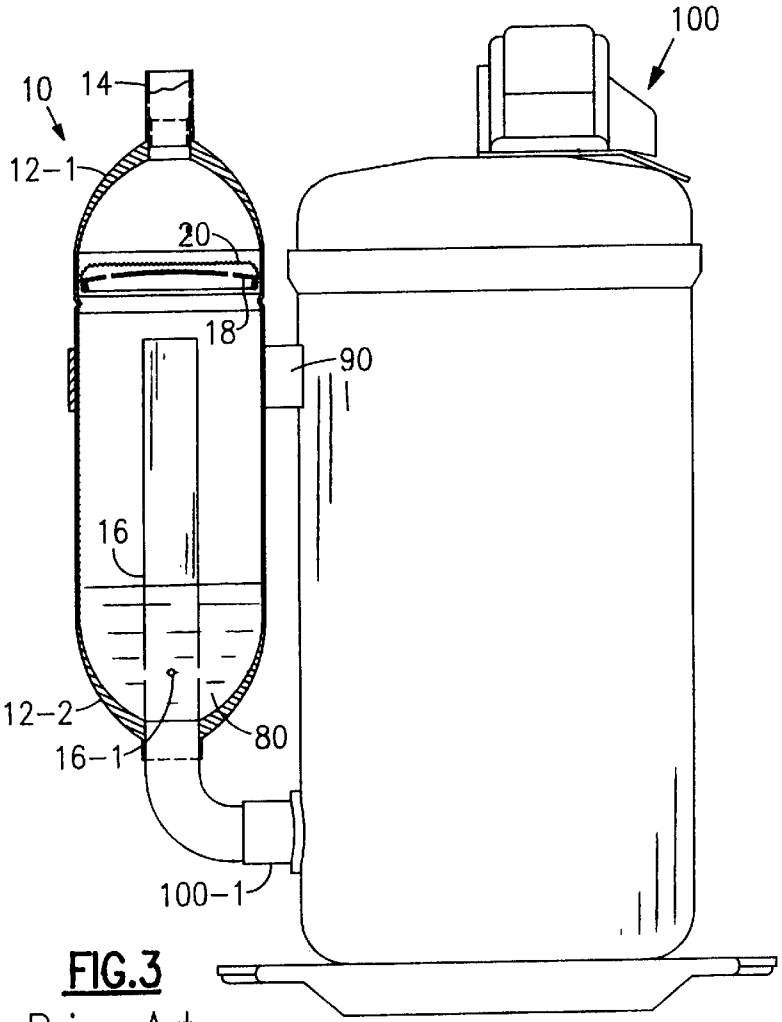
FIG.3 Prior Art
FIG. 3 is a partially sectioned view of a PRIOR ART accumulator and a hermetic compressor.

In FIGS. 1 and 3 the numeral 10 generally designates a PRIOR ART accumulator which, in FIG. 3, is secured to hermetic compressor 100 by circumferential band 90. Accumulator 10 includes a upper housing member 12-1 and a lower housing member 12-2 which are suitably sealed together, as by welding, to form housing 12. Inlet pipe 14 is sealingly secured to upper housing member 12-1 and would be fluidly connected to an evaporator (not illustrated) in an air conditioning or refrigeration system. Suction feed pipe 16 is sealingly received in lower housing 12-2 and extends into the interior of housing 12 a distance roughly corresponding to 60% of the axial length of housing 12. A metering port 16-1 is formed in suction feed pipe 16 at a location corresponding to the lower potion of the interior of housing 12 and is of a diameter on the order of 0.06 inches (1.5 mm). The interior of housing 12 is divided into an upper portion 12-3 and a lower portion 12-4 by baffle 18. Baffle 18 is suitably secured in housing 12 as by welding or an interference fit and has a plurality of holes 18-1 which provide fluid communication between upper portion 12-3 and lower portion 12-4 of the interior of casing 12. Holes 18-1 will typically be four to twelve in number and 0.18 to 0.8 inches in diameter with a total open space of 20 to 30%. Baffle 18 is overlain by screen 20 which is suitably secured in upper portion 12-3 and serves to filter the flow entering accumulator 10.

In operation, the running of high side hermetic compressor 100, which may be a reciprocating or rolling piston rotary compressor, tends to draw refrigerant from the evaporator (not illustrated) into accumulator 10 with the flow serially passing through inlet pipe 14 into upper portion 12-3 of housing 12, through screen 20 and holes 18-1 into lower portion 12-4 of housing 12. As is clear from the drawings, flow passing through holes 18-1 need only be diverted less than 90° to pass into the open end 16-2 of suction feed pipe 16. Flow through suction feed pipe 16 passes through suction inlet 100-1 into compressor 100 and is compressed. If there is any liquid refrigerant and/or oil 80 in lower portion 12-4 at a level up to or above metering port 16-1, the flow through suction feed pipe 16 aspirates the liquid 80 into the flow being supplied to suction inlet 100-1 of compressor 100. Liquid refrigerant 80 which is aspirated through metering port 16-1 tends to expand and become a gas due to the lowering of pressure in the suction flow.

Figure 2:
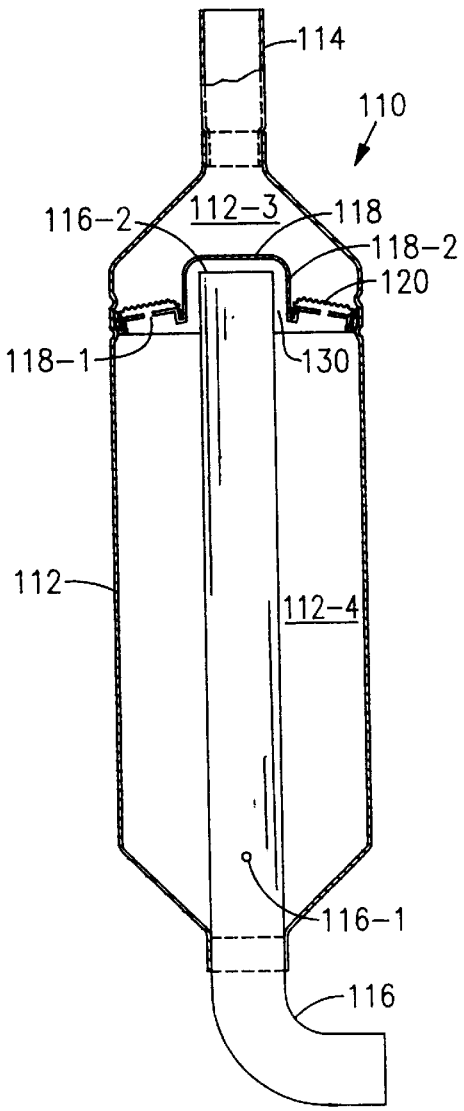
FIG. 2 is a partially sectioned view of an accumulator made according to the teachings of the present invention.
Figure 4:
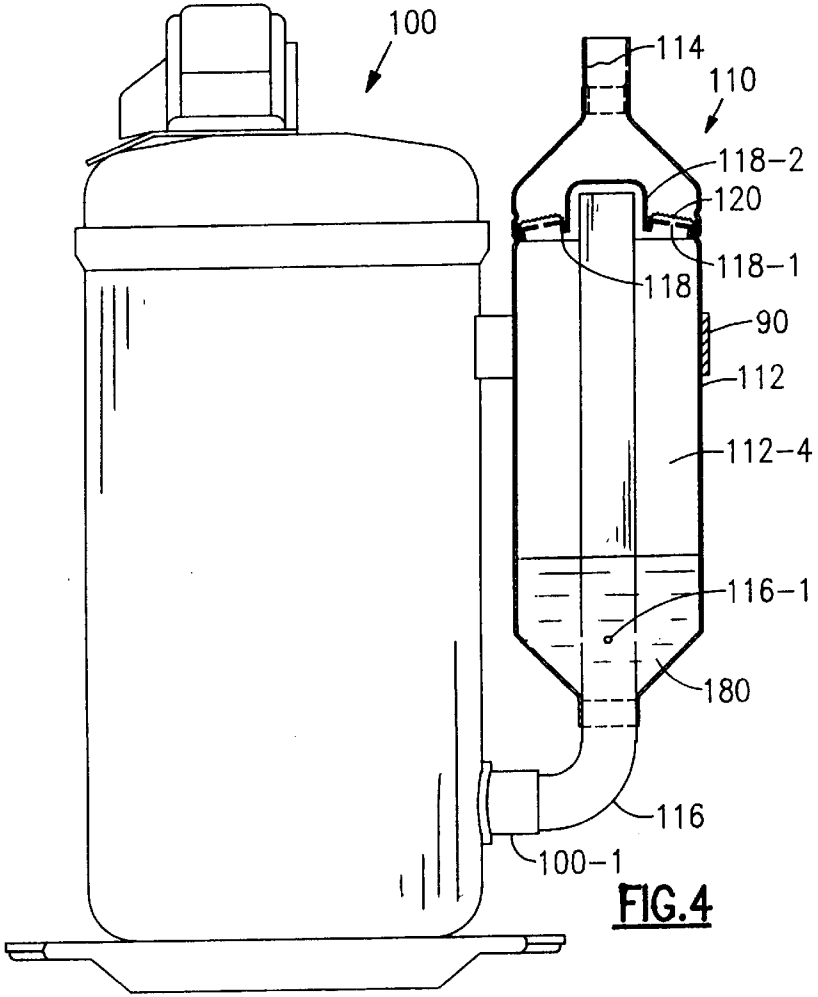
FIG. 4 is a partially sectioned view of an accumulator made according to the teachings of the present invention and a hermetic compressor.
Figure 5:
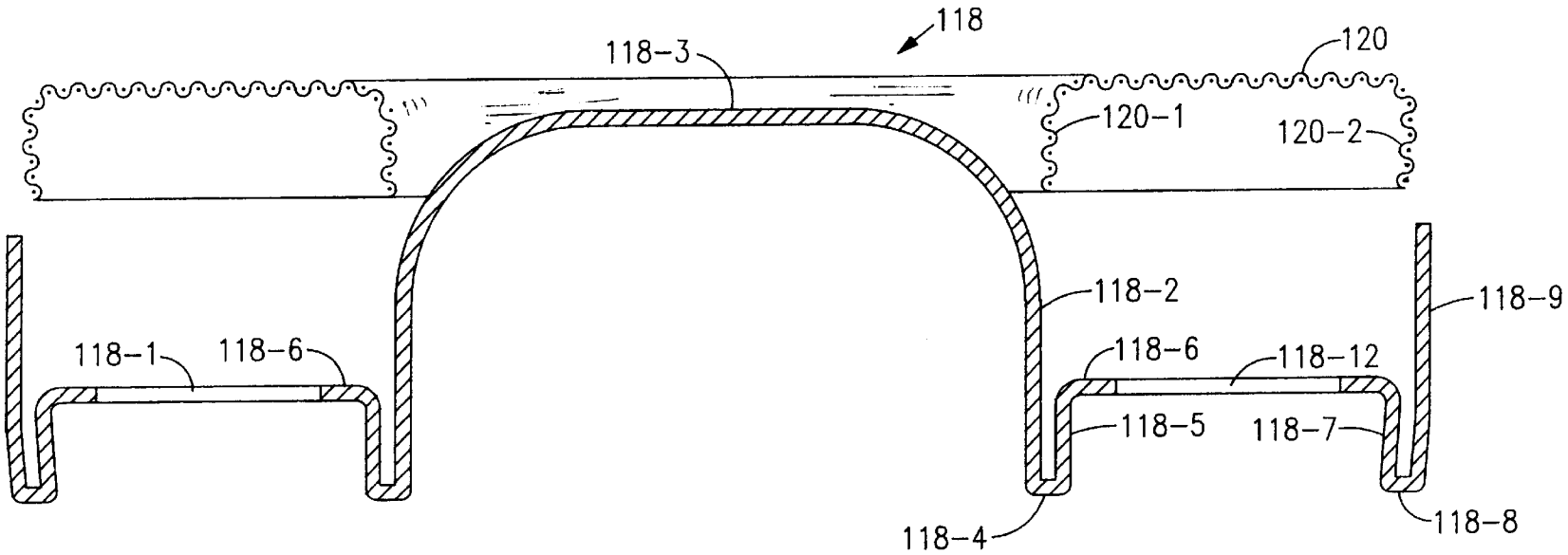
FIG. 5 is an exploded view of a portion of the accumulator of FIGS. 2 and 4.

Referring now to FIGS. 2, 4 and 5, structure of accumulator 110 has been numbered one hundred higher than the corresponding structure of FIGS. 1 and 3. Accumulator 110 differs from accumulator 10 in that suction feed pipe 116 is higher/longer, baffle 118 is modified, screen 120 is modified, upper portion 112-3 is smaller and lower portion 112-4 is larger. Referring to FIG. 5, baffle 118 has an axially extending central portion 118-2 having a closed end 118-3 which defines a bore for receiving open end 116-2 and a portion of suction feed pipe 116 in a spaced relationship. Axially extending portion 118-2 is connected to radially extending annular portion 118-6 containing holes 118-1 by bend 118-4 and axially extending annular portion 118-5 which is axially coextensive with a portion of axially extending portion 118-2. Axially extending portion 118-7 is connected to axially extending skirt portion 118-9 by bend 118-8 and is used to secure baffle 118 in place in accumulator housing 112. Annular, axially extending portions 120-1 and 120-2 of screen 120 are respectively received in the space defined between axially extending portion 118-2 and annular portion 118-5 and between axially extending portion 118-7 and skirt portion 118-9, respectively.

Comparing accumulators 10 and 110 which are presented side-by-side in FIGS. 1 and 2 and in FIGS. 3 and 4, respectively, it will be noted that suction feed pipe 116 is longer than suction feed pipe 16 and that open end 116-2 of suction feed pipe 116 is above holes 118-1 whereas open end 16-2 is beneath holes 18-1. Upper portion 112-3 is smaller than upper portion 12-3 and lower portion 112-4 is larger than lower portion 12-4. Open end 116-2 is separated from holes 118-1 by annular portion 118-5, bend 118-4 and the annular flow path between suction feed pipe 116 and axially extending portion 118-2 whereas there is no physical barrier between holes 18-1 and open end 16-2.

In operation, the running of high side hermetic compressor 100 will draw refrigerant from the evaporator (not illustrated) into accumulator 110 with the flow serially passing through inlet pipe 114 into upper portion 112-3 of housing 112, through annular screen 120 and holes 118-1 in baffle 118 into lower portion 112-4 of housing 112. The flow through holes 118-1 must make a 1800 turn about bend 118-4 which tends to separate out entrained liquid which collects in the bottom of lower portion 112-4. The flow making the 180° turn about bend 118-4 passes through the annular, axially extending space 130 between the outer portion of suction feed pipe 116 and the inner surface of axially extending portion 118-2 before encountering the inner surface of closed end 118-3 requiring a 180° turn to enter open end 116-2 of suction feed pipe 116 and providing a second fluid separation as well as a quieter flow due to the circuitous path. Flow through suction feed pipe 116 passes through suction inlet 100-1 into compressor 100 and is compressed. If there is any liquid refrigerant and/or oil 180 in lower portion 112-4 at a level up to or above metering port 116-1, the flow through suction feed pipe 116 aspirates the liquid 180 into the flow being supplied to suction inlet 100-1 of compressor 100. Because the height of open end 16-2 and 1162 are the limits for liquid storage in accumulators 10 and 110, respectively, accumulator 110 can clearly store more liquid. Liquid refrigerant 180 which is aspirated through metering port 116-1 tends to expand and become a gas due to the lowering of the pressure in the suction flow.

Figure 6:
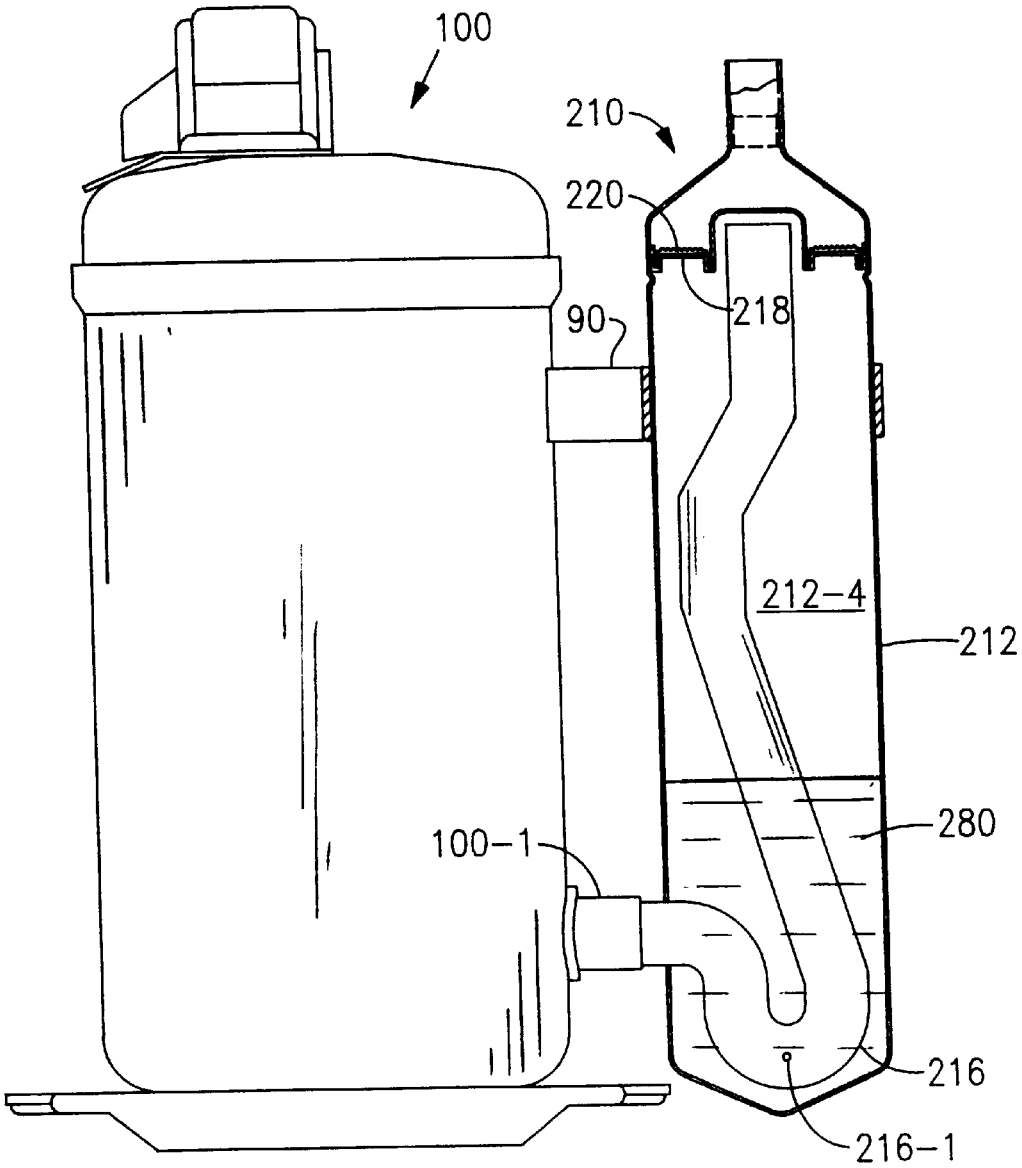
FIG. 6 is a partially sectioned view of a modified accumulator made according to the teachings of the present invention and a hermetic compressor.

FIG. 6 employs a modified accumulator 210 where the structure of accumulator 210 has been numbered one hundred higher than the corresponding structure of FIGS. 2, 4 and 5. Baffle 218 and screen 220 would be the same as baffle 118 and screen 120. Directly comparing FIGS. 4 and 6, it will be noted that housing 212 extends below suction inlet 100-1, that suction feed pipe 216 contains a number of bends to accommodate the U-bend permitting the locating of metering port 216-1 near the bottom of lower portion 212-4 and the side discharge connecting with suction inlet 100-1. Obviously accumulator 210 has a larger liquid storage capacity than accumulator 110. However the portion of lower portion 212-4 located at and above metering port 216-1 and at or below suction inlet 100-1 permits the initial storage of oil to replace that removed from the compressor 100 in normal operation and coating and collecting in other parts of the air conditioning or refrigeration system (not illustrated) while not requiring that this oil be initially located in compressor 100.

The operation of accumulator 210 will be the same as that of accumulator 110 with one exception. If oil is the initial liquid 280 stored in accumulator 210 prior to initial start up of compressor, oil will be aspirated into suction feed pipe 216 via metering port 216-1 and will be distributed through the entire system with the refrigerant without compromising the required oil charge required in compressor 100.

Although preferred embodiments of the present invention have been described and illustrated, other modifications will occur to those skilled in the art. It is therefore intended that the present invention is to be limited only by the scope of the appended claims.

What is claimed is:

1. An accumulator comprising:

a housing having an interior;

a baffle located in said interior and dividing said interior into an upper portion and a lower portion;

at least one hole in said baffle providing fluid communication between said upper portion and said lower portion;

means for supplying refrigerant to said upper portion;

means for withdrawing refrigerant from said lower portion and passing said withdrawn refrigerant from said housing;

said baffle including an annular portion with said at least one hole located therein, a cylindrical section extending both above and below said annular portion and having a closed end located above said annular portion;

said means for withdrawing refrigerant including a pipe having an open end located in said cylindrical section and above said annular portion so as to define with said cylindrical section an annular flow path whereby flow passing from said upper portion to said means for withdrawing serially passes downwardly through said at least one hole and past that portion of said cylindrical section which extends below said annular portion, upwardly through said annular flow path and into said means for withdrawing.

2. The accumulator of claim 1 wherein said closed end of said baffle is spaced from said open end of said pipe whereby flow through said annular flow path must turn on the order of 180° to enter said open end.

3. The accumulator of claim 1 further including a hermetic compressor and said means for withdrawing fluidly connected to said compressor for supplying refrigerant thereto.

4. An accumulator comprising:

a hermetic compressor;

a housing having an interior;

a baffle located in said interior and dividing said interior into upper portion and a lower portion;

at least one hole in said baffle providing fluid communication between said upper portion and said lower portion;

means for supplying refrigerant to said upper portion;

means for withdrawing refrigerant from said lower portion and passing said withdrawn refrigerant from said housing and said means for withdrawing fluidly connected to said compressor for supplying refrigerant thereto;

said baffle including annular portion with said at least one hole located therein, a cylindrical section extending both above and below said annular portion and having a closed end located above said annular portion;

said means for withdrawing refrigerant including a pipe having an open end located in said cylindrical section and above said annular portion so as to define with said cylindrical section an annular flow path whereby flow passing from said upper portion to said means for withdrawing serially passes downwardly though said at least one hole and past that portion of said cylindrical section which extends below said annular portion, upwardly through said annular flow path and into said means for withdrawing.

5. The accumulator of claim 4 wherein a portion of said means for withdrawing is located in said lower portion of said interior below where said means for withdrawing is fluidly connected to said compressor and has a metering port in said portion of said means for withdrawing providing fluid communication between said lower portion of said interior and said means for withdrawing.

6. The accumulator of claim 5 wherein said at least one hole is overlaid by a screen.

7. The accumulator of claim 1 wherein said at least one hole is overlaid by a screen.

8. A hermetic compressor having an accumulator secured thereto, said accumulator comprising:

a housing having an interior;

a baffle located in said interior and dividing said interior into an upper portion and a lower portion;

at least one hole in said baffle providing fluid communication between said upper portion and said lower portion;

means for supplying refrigerant to said upper portion;

means for withdrawing refrigerant from said lower portion and passing said withdrawn refrigerant from said housing;

said baffle including an annular portion with said at least one hole located therein, a cylindrical section extending both above and below said annular portion and having a closed end located above said annular portion;

said means for withdrawing refrigerant including a pipe having an open end located in said cylindrical section and above said annular portion so as to define with said cylindrical section an annular flow path whereby flow passing from said upper portion to said means for withdrawing serially passes downwardly through said at least one hole and past that portion of said cylindrical section which extends below said annular portion, upwardly through said annular flow path and into said means for withdrawing; and said means for withdrawing fluidly connected to said compressor for supplying refrigerant thereto.

9. A hermetic compressor having an accumulator secured thereto, said accumulator comprising:

a housing having an interior;

a baffle located in said interior and dividing said interior into an upper portion and a lower portion;

at least one hole in said baffle providing fluid communication between said upper portion and said lower portion;

means for supplying refrigerant to said upper portion;

means for withdrawing refrigerant from said lower portion and passing said withdrawn refrigerant from said housing;

said baffle including an annular portion with said at least one hole located therein, a cylindrical section extending both above and below said annular portion and having a closed end located above said annular portion;

said means for withdrawing refrigerant including a pipe having an open end located in said cylindrical section and above said annular portion so as to define with said cylindrical section an annular flow path whereby flow passing from said upper portion to said means for withdrawing serially passes downwardly through said at last one hole and past that portion of said cylindrical section which extends below said annular portion, upwardly through said annular flow path and into said means for withdrawing;

said means for withdrawing fluidly connected to said compressor for supplying refrigerant thereto; and wherein said lower portion extends below where said means for withdrawing is fluidly connected to said compressor.

10. The compressor of claim 9 wherein a portion of said means for withdrawing is located in said lower portion of said interior below where said means for withdrawing is fluidly connected to said compressor and has a metering port in said portion of said means for withdrawing providing fluid communication between said lower portion of said interior and said means for withdrawing.

11. The compressor of claim 10 wherein said at least one hole is overlaid by a screen.

12. An accumulator comprising:

a housing having an interior;

a baffle located in said interior and dividing said interior into an upper portion and a lower portion;

at least one hole in said baffle providing fluid communication between said upper portion and said lower portion;

means for supplying refrigerant to said upper portion;

means for withdrawing refrigerant from said lower portion and passing said withdrawn refrigerant from said housing;

said baffle including an annular portion with said at least one hole located therein, a cylindrical section extending both above and below said annular portion and having a closed end located above said annular portion, said cylindrical section partially defining the peripheral shape of said baffle;

said means for withdrawing refrigerant including a pipe having an open end located in said cylindrical section and above said annular portion so as to define with said cylindrical section an annular flow path whereby flow passing from said upper portion to said means for withdrawing serially passes downwardly through said at least one hole and past that portion of said cylindrical section which extends below said annular portion, upwardly through said annular flow path and into said means for withdrawing.

* * * * *